US010861645B2

(12) United States Patent
Kuribayashi et al.

(10) Patent No.: US 10,861,645 B2
(45) Date of Patent: Dec. 8, 2020

(54) METHOD FOR PRODUCING RARE-EARTH MAGNETS, AND SLURRY APPLICATION DEVICE

(71) Applicant: SHIN-ETSU CHEMICAL CO., LTD., Tokyo (JP)

(72) Inventors: Yukihiro Kuribayashi, Echizen (JP); Shogo Kamiya, Echizen (JP); Harukazu Maegawa, Echizen (JP); Shintaro Tanaka, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 225 days.

(21) Appl. No.: 15/570,223

(22) PCT Filed: Apr. 18, 2016

(86) PCT No.: PCT/JP2016/062202
§ 371 (c)(1),
(2) Date: Oct. 27, 2017

(87) PCT Pub. No.: WO2016/175065
PCT Pub. Date: Nov. 3, 2016

(65) Prior Publication Data

US 2018/0294095 A1 Oct. 11, 2018

(30) Foreign Application Priority Data

Apr. 28, 2015 (JP) ..... 2015-092038

(51) Int. Cl.
*H01F 41/02* (2006.01)
*B22F 3/24* (2006.01)
(Continued)

(52) U.S. Cl.
CPC ..... *H01F 41/0253* (2013.01); *B05C 3/10* (2013.01); *B05D 1/18* (2013.01); *B05D 3/0254* (2013.01);
(Continued)

(58) Field of Classification Search
CPC .. H01F 41/00; H01F 41/0253; H01F 41/0293; H01F 41/42; H01F 41/309;
(Continued)

(56) References Cited

U.S. PATENT DOCUMENTS 7,559,996 B2 7/2009 Miyata et al.
8,377,233 B2 2/2013 Nakamura et al.
(Continued)

FOREIGN PATENT DOCUMENTS

JP 04-150969 A 5/1992
JP 200-066682 * 3/2002
(Continued)

OTHER PUBLICATIONS

Extended European Search Report, dated Nov. 20, 2018, for European Application No. 16786342.2.
(Continued)

*Primary Examiner* — Tabassom Tadayyon Eslami
(74) *Attorney, Agent, or Firm* — Birch, Stewart, Kolasch & Birch, LLP

(57) ABSTRACT

A method for producing rare-earth magnets is provided in which, when a slurry 2 having a rare-earth-compound powder dispersed therein is applied to sintered magnet bodies 1 and dried to apply the powder thereto, the magnet bodies 1 are accommodated and conveyed in holding pockets 42 of a conveyance drum 4 which rotates in a state of being partially immersed in the slurry 2, and, as a result, the magnet bodies 1 are immersed in the slurry 2, withdrawn from the slurry 2, and dried to apply the powder to the sintered magnet bodies
(Continued)

1. According to this production method, the powder can be uniformly and efficiently applied, wastage of the rare-earth compound can be effectively suppressed, and a reduction in the surface area of equipment for performing an application step can also be achieved.

7 Claims, 4 Drawing Sheets

(51) Int. Cl.

| | |
|---|---|
| ***C22C 38/00*** | (2006.01) |
| ***B05C 3/10*** | (2006.01) |
| ***C22C 33/02*** | (2006.01) |
| ***H01F 1/057*** | (2006.01) |
| ***B05D 1/18*** | (2006.01) |
| ***B05D 3/02*** | (2006.01) |
| ***B22F 3/16*** | (2006.01) |
| ***B22F 9/04*** | (2006.01) |
| ***C21D 6/00*** | (2006.01) |
| ***C22C 38/02*** | (2006.01) |
| ***C22C 38/06*** | (2006.01) |
| ***C22C 38/16*** | (2006.01) |
| ***H01F 1/08*** | (2006.01) |

(52) U.S. Cl.
CPC ..... *B22F 3/162* (2013.01); *B22F 3/24* (2013.01); *B22F 9/04* (2013.01); *C21D 6/008* (2013.01); *C22C 33/02* (2013.01); *C22C 38/00* (2013.01); *C22C 38/005* (2013.01); *C22C 38/02* (2013.01); *C22C 38/06* (2013.01); *C22C 38/16* (2013.01); *H01F 1/0577* (2013.01); *H01F 1/086* (2013.01); *H01F 41/02* (2013.01); *H01F 41/0293* (2013.01); *B22F 2003/247* (2013.01); *B22F 2009/044* (2013.01); *B22F 2301/355* (2013.01)

(58) Field of Classification Search
CPC ..... H01F 7/02; H01F 7/053; H01F 7/0536; B05C 3/10; B05C 9/14; B05C 13/02; B05C 3/109; B05C 5/002; B05C 3/132; B05C 3/02; B05C 13/00; B65G 47/5136; B65G 31/04; B65G 31/02; B65G 31/24; B65G 49/00; B65G 49/02; B65G 17/50; B65G 29/00; B65G 49/025; B65G 49/04; B65G 49/0409; B65G 49/08; B65G 47/47; B65G 47/34
USPC ..... 118/230, 232, 416, 423, 429, 405, 418, 118/426; 427/129, 458, 472
See application file for complete search history.

(56) References Cited

U.S. PATENT DOCUMENTS

| | | | | |
|---|---|---|---|---|
| 2002/0023692 | A1 | 2/2002 | Tochishita et al. | |
| 2005/0257739 | A1* | 11/2005 | Schaeuble | B05C 3/08 118/416 |
| 2008/0245442 | A1* | 10/2008 | Nakamura | B22F 9/023 148/101 |
| 2012/0139388 | A1* | 6/2012 | Iwasaki | B22F 3/24 310/254.1 |
| 2013/0271248 | A1* | 10/2013 | Nagata | H01F 1/0311 335/302 |
| 2015/0086710 | A1 | 3/2015 | Takagi | |

FOREIGN PATENT DOCUMENTS

| | | | |
|---|---|---|---|
| JP | 2002-102998 | A | 4/2002 |
| JP | 2002102998 | * | 4/2002 |
| JP | 2007-053351 | A | 3/2007 |
| JP | 2012-142425 | A | 7/2012 |
| JP | 2013-144358 | A | 7/2013 |
| JP | 2013-153172 | A | 8/2013 |
| JP | 2015-065218 | A | 4/2015 |
| WO | WO 2006/043348 | A1 | 4/2006 |

OTHER PUBLICATIONS

International Search Report for PCT/JP2016/062202 (PCT/ISA/210) dated Jul. 19, 2016.
Written Opinion of the International Searching Authority for PCT/JP2016/062202 (PCT/ISA/237) dated Jul. 19, 2016.

* cited by examiner

METHOD FOR PRODUCING RARE-EARTH MAGNETS, AND SLURRY APPLICATION DEVICE

TECHNICAL FIELD

This invention relates to a method for producing rare earth magnet by coating a sintered magnet body with a rare earth compound-containing powder and heat treating for causing the rare earth element to be absorbed in the sintered magnet body, wherein the rare earth compound powder is efficiently coated and rare earth magnet having excellent magnetic properties is efficiently produced; and a rare earth compound application device suited for use in the rare earth magnet producing method.

BACKGROUND ART

Rare earth permanent magnets including Nd—Fe—B base magnets find an ever spreading application owing to their excellent magnetic properties. Methods known in the art for further improving the coercivity of these rare earth magnets include a method for producing a rare earth permanent magnet by coating the surface of a sintered magnet body with a rare earth compound powder, and heat treating the coated body for causing the rare earth element to be absorbed and diffused in the sintered magnet body (Patent Document 1: JP-A 2007-053351, Patent Document 2: WO 2006/043348). This method is successful in increasing coercivity while suppressing any decline of remanence.

In the prior art, for coating the rare earth compound, methods of applying a slurry of a rare earth compound-containing powder dispersed in water or organic solvent to a sintered magnet body by immersing the magnet body in the slurry, or spraying the slurry to the magnet body, to coat the magnet body with the slurry, and then drying are generally employed. In the case of immersion coating, it is common in view of productivity to adopt a net conveyor system wherein a plurality of sintered magnet bodies are continuously conveyed and coated by means of a net conveyor.

That is, the net conveyor system includes a net conveyor c as shown in FIG. 4. A plurality of sintered magnet bodies 1 are rested on the net conveyor c while they are spaced apart at predetermined intervals. The magnet bodies 1 are continuously conveyed, passed through a coating tank t filled with the slurry 2 in the course of conveyance, where they are immersed in and coated with the slurry, withdrawn from the slurry 2, further conveyed while being rested on the net conveyor c, and passed through a drying zone 3 equipped with a layer-providing setup where they are dried, i.e., the solvent in the slurry is removed. In this way, the rare earth compound powder is coated.

However, the net conveyor system tends to give rise to problems that in the coating steps including entry and immersion of sintered magnet bodies 1 in the slurry 2, and withdrawn of sintered magnet bodies 1 from the slurry 2, the sintered magnet bodies 1 move on the conveyor to come in contact with each other, causing coating failures on the contact surfaces, that the slurry tends to deposit or stick to the conveyor system to invite mechanical failures, and that the slurry 2 is carried over outside the coating tank t by the conveyor belt, indicating that noble rare earth compound is consumed in waste. There is also a problem that the system tends to occupy a large footprint because the steps from slurry coating to drying are carried out while the sintered magnet bodies are conveyed horizontally by the net conveyor.

PRIOR ART DOCUMENTS

Patent Documents

Patent Document 1: JP-A 2007-053351
Patent Document 2: WO 2006/043348

SUMMARY OF THE INVENTION

Problems to be Solved by the Invention

An object of the invention, which is made under the above circumstances, is to provide a method for producing rare earth magnet comprising the steps of applying a slurry of a powder in a solvent to the surface of a sintered magnet body of $R^1$—Fe—B composition (wherein $R^1$ is one or more elements selected from Y, Sc and rare earth elements), the powder containing one or more compounds selected from an oxide, fluoride, oxyfluoride, hydroxide and hydride of $R_2$ (wherein $R_2$ is one or more elements selected from Y, Sc and rare earth elements), drying the slurry to coat the magnet body with the powder, and heat treating the coated magnet body, the method being capable of applying the slurry uniformly and efficiently to coat the powder uniformly and efficiently, while effectively suppressing the wasting of the rare earth compound, and reducing the area of the system for carrying out the coating steps; and a rare earth compound application device suited for use in the rare earth magnet producing method.

Means for Solving the Problems

To attain the above object, the invention provides a method for producing rare earth magnet as defined below as [1] to [8].

[1] A method for producing rare earth permanent magnet comprising the steps of applying a slurry of a powder in a solvent to sintered magnet bodies of $R^1$—Fe—B composition (wherein $R^1$ is one or more elements selected from Y, Sc and rare earth elements), the powder containing one or more compounds selected from an oxide, fluoride, oxyfluoride, hydroxide and hydride of $R_2$ (wherein $R_2$ is one or more elements selected from Y, Sc and rare earth elements), drying the slurry to coat the sintered magnet bodies with the powder, and heat treating the coated bodies for causing $R_2$ to be absorbed in the sintered magnet bodies, the method further comprising the steps of:

providing a conveyor drum having a plurality of holding pockets circumferentially arranged in its periphery, rotating the conveyor drum while a portion of the drum is immersed in the slurry, placing a sintered magnet body in one holding pocket at a predetermined position of the drum prior to entry into the slurry, so that the sintered magnet body is held in the holding pocket, the sintered magnet body being conveyed along the rotational track of the conveyor drum, immersed in the slurry, then withdrawn from the slurry, and conveyed further whereby the slurry is dried and the sintered magnet body is coated with the powder, recovering the sintered magnet body from the pocket at a predetermined position after the drying treatment and prior to re-entry into the slurry, and subjecting the sintered magnet body to the subsequent heat treatment.

[2] The rare earth magnet producing method of [1] wherein the holding pocket is a pocket of circular bore shape axially extending throughout the conveyor drum, an uncoated sintered magnet body is inserted into the pocket from one side surface of the conveyor drum, a coated sintered magnet body, which has been accommodated in the pocket, is displaced by the uncoated sintered magnet body to the other side surface of the conveyor drum, for thereby recovering the coated sintered magnet body from the pocket, whereby supply and recovery of sintered magnet bodies are simultaneously performed.

[3] The rare earth magnet producing method of [2] wherein a plurality of conveyor drums are juxtaposed with their side surfaces closely opposed, the powder coating process is carried out on each conveyor drum, the sintered magnet body is inserted into the holding pocket in one drum, and at the same time, the sintered magnet body, which has been accommodated in the pocket, is displaced into the pocket in another drum and accommodated therein, whereby the coating process from slurry immersion to drying is repeated plural times.

[4] The rare earth magnet producing method of any one of [1] to [3] wherein the sintered magnet body supplied into the holding pocket is recovered after the conveyor drum is rotated plural turns, whereby the coating process from slurry immersion to drying is repeated plural times.

[5] The rare earth magnet producing method of any one of [1] to [4] wherein the conveyor drum has a main body composed of a frame and a mesh metal or punching metal.

[6] The rare earth magnet producing method of any one of [1] to [5] wherein the step of drying the sintered magnet body which is withdrawn from the slurry and conveyed further includes blowing air thereto.

[7] The rare earth magnet producing method of [6] wherein the drying step includes injecting air at a temperature within the boiling point ($T_B$) of the solvent in the slurry ±50° C. to the sintered magnet body.

[8] The rare earth magnet producing method of [6] or [7] wherein the drying step includes injecting air to the sintered magnet body which is withdrawn from the slurry, for thereby removing any residual droplets, and then injecting hot air thereto.

To attain the above object, the invention also provides a slurry application device as defined below as [9] to [14].

[9] A device for applying rare earth compound when rare earth permanent magnet is produced by applying a slurry of a powder in a solvent to sintered magnet bodies of $R^1$—Fe—B composition (wherein $R^1$ is one or more elements selected from Y, Sc and rare earth elements), the powder containing one or more compounds selected from an oxide, fluoride, oxyfluoride, hydroxide and hydride of $R_2$ (wherein $R_2$ is one or more elements selected from Y, Sc and rare earth elements), drying the slurry to coat the sintered magnet bodies with the powder, and heat treating the coated bodies for causing $R_2$ to be absorbed in the sintered magnet bodies, the device comprising an applicator tank for containing the slurry, a conveyor drum which rotates while a portion of the drum is immersed in the slurry, a plurality of holding pockets circumferentially arranged in the periphery of the conveyor drum, and drying means for blowing air into the holding pocket for drying the sintered magnet body accommodated in the pocket, wherein a sintered magnet body is supplied into one holding pocket at a predetermined position of the drum prior to entry into the slurry, the sintered magnet body held in the pocket is conveyed along the rotational track of the conveyor drum, immersed in the slurry, then withdrawn from the slurry, and dried by the drying means, and the sintered magnet body is recovered from the pocket at a predetermined position after the drying treatment and prior to re-entry into the slurry.

[10] The rare earth compound application device of [9] wherein the conveyor drum has a main body composed of a frame and a mesh metal or punching metal.

[11] The rare earth compound application device of [9] or [10] wherein the drying means is adapted to blow hot air into the holding pocket to dry the sintered magnet body therein, the device further comprising droplet removing means for injecting air to the sintered magnet body accommodated in the pocket for thereby removing any residual droplets, prior to the drying treatment.

[12] The rare earth compound application device of any one of [9] to [11] wherein the holding pocket is a pocket of circular bore shape axially extending throughout the conveyor drum, an uncoated sintered magnet body is inserted into the pocket from one side surface of the conveyor drum, a coated sintered magnet body, which has been accommodated in the pocket, is displaced by the uncoated sintered magnet body to the other side surface of the conveyor drum, for thereby recovering the coated sintered magnet body from the pocket.

[13] The rare earth compound application device of [12] wherein a plurality of conveyor drums are juxtaposed with their side surfaces closely opposed, the powder coating process is carried out on each conveyor drum, the sintered magnet body is inserted into the holding pocket in one drum, and at the same time, the sintered magnet body, which has been accommodated in the pocket, is displaced into the pocket in another drum and accommodated therein, whereby the coating process from slurry immersion to drying is repeated plural times.

[14] The rare earth compound application device of any one of [9] to [13] wherein the sintered magnet body supplied into the holding pocket is recovered after the conveyor drum is rotated plural turns, whereby the coating process from slurry immersion to drying is repeated plural times.

That is, according to the producing method and application device of the invention, as a conveyor drum rotates while being partly immersed in a slurry, sintered magnet bodies are conveyed by the conveyor drum while being accommodated in holding pockets arranged in the periphery of the conveyor drum, and in the course of conveyance, the magnet bodies are passed through the slurry, coated therewith, and dried whereby the sintered magnet bodies are surface coated with the powder.

Advantageous Effects of the Invention

As mentioned above, sintered magnet bodies are conveyed by the conveyor drum while being accommodated in holding pockets of the drum, coated with the slurry and dried. Even when the coating step is carried out continuously on a plurality of sintered magnet bodies, it is avoided that sintered magnet bodies come in contact with each other so that coating failures occur at contact areas. The slurry is uniformly and properly applied, and sintered magnet bodies are uniformly and efficiently coated with the powder. Since the conveyor drum rotates while a portion thereof is immersed in the slurry in the coating tank, the slurry carried over by the conveyor drum is returned to the coating tank as a result of rotation of the drum, so that little of the slurry is carried out of the coating tank. As compared with the net conveyor system, the wasting of rare earth compound is effectively minimized. Furthermore, since the conveyance track of sintered magnet bodies by the conveyor drum is a circular track delineated above the coating tank by rotation of the conveyor drum, the system is made compact to substantially reduce its footprint, as compared with the net conveyor system entailing a horizontal conveyance track.

In addition, according to the producing method and application device of the invention, the sintered magnet bodies are uniformly coated over the entire surface with the rare earth compound powder and the coating step is carried out quite efficiently. Rare earth magnet having improved magnetic properties including a fully increased coercivity can be efficiently produced.

BRIEF DESCRIPTION OF THE DIAGRAMS

EMBODIMENT FOR CARRYING OUT THE INVENTION

Figure 1:
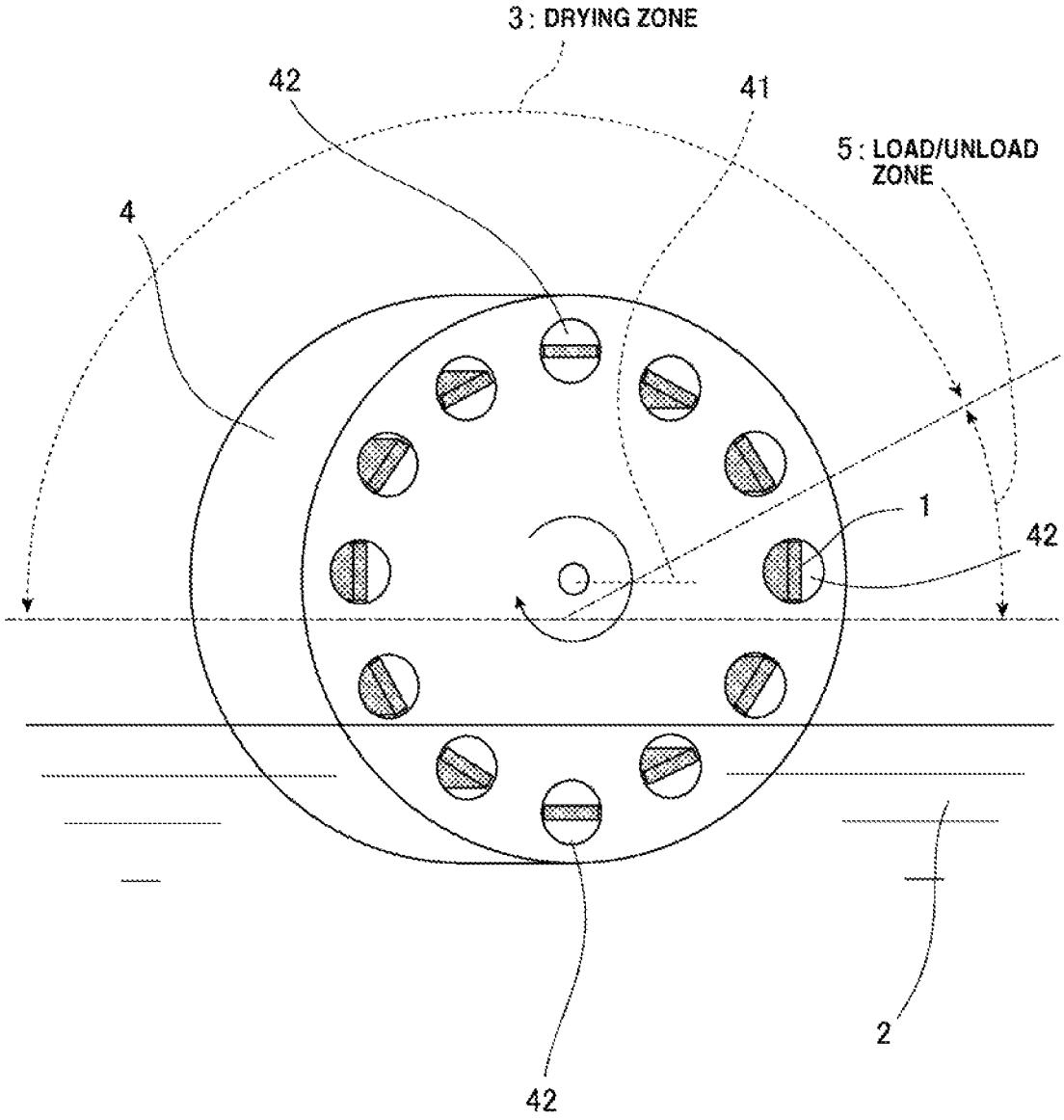
FIG. 1 is a schematic view showing an application device in one embodiment of the invention.

As described above, the method for producing rare earth magnet according to the invention includes the steps of applying a slurry of a powder in a solvent to sintered magnet bodies of $R^1$—Fe—B composition (wherein $R^1$ is one or more elements selected from Y, Sc and rare earth elements), the powder containing one or more compounds selected from an oxide, fluoride, oxyfluoride, hydroxide and hydride of $R_2$ (wherein $R_2$ is one or more elements selected from Y, Sc and rare earth elements), drying the slurry to coat the magnet bodies with the powder, and heat treating the coated magnet bodies for causing $R_2$ to be absorbed in the magnet bodies.

The $R^1$—Fe—B sintered magnet body used herein may be one obtained by any well-known method. For example, a sintered magnet body may be obtained by coarsely milling a mother alloy containing $R^1$, Fe and B, finely pulverizing, compacting and sintering according to the standard method. It is noted that $R^1$ is one or more elements selected from Y, Sc and rare earth elements, specifically Y, Sc, La, Ce, Pr, Nd, Sm, Eu, Gd, Tb, Dy, Ho, Er, Yb, and Lu.

According to the invention, the $R^1$—Fe—B sintered magnet body is shaped to a predetermined shape as by grinding, if necessary, coated on its surface with a powder containing one or more compounds selected from an oxide, fluoride, oxyfluoride, hydroxide and hydride of $R^2$, and heat treated for causing absorption and diffusion (grain boundary diffusion) of $R_2$ into the sintered magnet body, thereby obtaining the desired rare earth magnet.

It is noted that $R_2$ is one or more elements selected from Y, Sc and rare earth elements, specifically Y, Sc, La, Ce, Pr, Nd, Sm, Eu, Gd, Tb, Dy, Ho, Er, Yb, and Lu, like $R^1$ mentioned above. It is preferred, though not limited, that $R_2$ contain at least 10 at %, more preferably at least 20 at %, and even more preferably at least 40 at % in total of Dy and/or Tb. It is more preferred in view of the object of the invention that $R_2$ contain at least 10 at % of Dy and/or Tb and the total concentration of Nd and Pr in $R_2$ be lower than the total concentration of Nd and Pr in $R^1$.

According to the invention, the powder is coated by dispersing the powder in a solvent to prepare a slurry, applying the slurry to the surface of the sintered magnet body, and drying. While the particle size of the powder is not particularly limited, a particle size commonly employed as a rare earth compound powder used for absorptive diffusion (grain boundary diffusion) may be selected, and specifically, an average particle size of preferably up to 100 μm, more preferably up to 10 μm. The lower limit of particle size is preferably at least 1 nm, though not limited. The average particle size may be determined as a weight average value $D_{50}$ (i.e., particle size corresponding to a cumulative weight of 50% or median diameter) using a particle size distribution measuring system based on the laser diffraction method or the like. The solvent in which the powder is dispersed may be water or an organic solvent. Examples of the organic solvent include ethanol, acetone, methanol, and isopropyl alcohol, but are not limited thereto. Inter alia, ethanol is preferably used.

Although the amount of the powder dispersed in the slurry is not particularly limited, a slurry having the powder dispersed in a dispersing amount of preferably at least 1%, more preferably at least 10%, even more preferably at least 20% as mass fraction is used in order to coat the powder effectively and efficiently. Since too much dispersing amounts give rise to inconvenience such as failure to form a uniform dispersion, the upper limit is preferably up to 70%, more preferably up to 60%, even more preferably up to 50% as mass fraction.

According to the invention, as the method of applying the slurry to the sintered magnet body and drying to coat the surface of the magnet body with the powder, a method of using a conveyor drum, conveying the sintered magnet body thereby, passing the magnet body through the slurry, thereby immersing the magnet body in the slurry and coating the magnet body with the slurry, and drying while further conveying the magnet body by the conveyor drum is employed. Specifically, coating of the powder may be carried out using the application device shown in FIGS. 1 and 2.

Figure 2:
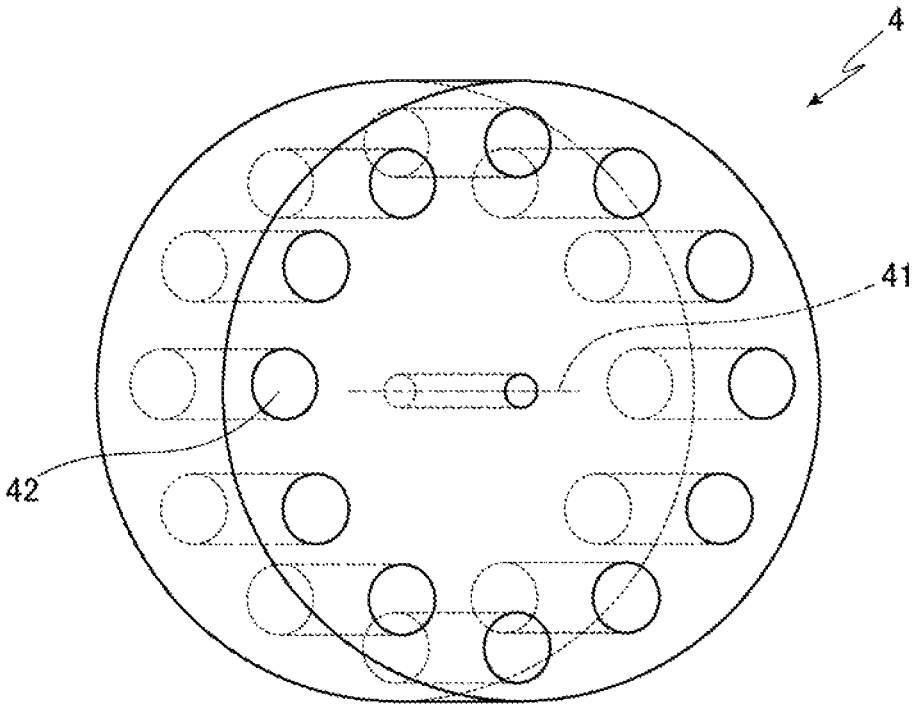
FIG. 2 is a schematic perspective view showing a conveyor drum in the application device.

FIGS. 1 and 2 schematically illustrate a rare earth compound application device in one embodiment of the invention. The application device includes a conveyor drum 4 adapted to rotate about a horizontal axis 41 by a rotational drive mechanism (not shown). The conveyor drum 4 is positioned such that a portion thereof is immersed in a slurry 2 contained in a coating tank (not shown). In FIG. 1, a portion of the drum corresponding to 4 to 8 o'clock on the clock dial is immersed in the slurry 2. While the range of immersion in the slurry 2 is not limited to the range shown in FIG. 1, the setup may be such that at least one holding pocket 42 (to be described later) at the lowest point is completely immersed in the slurry 2 and the horizontal axis 41 is located above the surface of the slurry 2. It is noted that although the conveyor drum 4 is adapted to rotate about the horizontal axis 41 in the illustrated embodiment, the rotational axis of the conveyor drum need not necessarily be a horizontal axis, as long as the conveyor drum rotates while a portion of the drum is necessarily immersed in the slurry, and the sintered magnet body held by the conveyor drum is once completely immersed in the slurry and withdrawn from the slurry in accordance with rotation of the drum.

The conveyor drum 4 is provided with a plurality of (twelve in the figure) holding pockets 42 which are circumferentially arranged in a row and at an equal spacing. As the drum 4 rotates with the sintered magnet bodies 1 accommodated and held in the holding pockets 42, the sintered magnet bodies 1 are conveyed along a circular track. The holding pockets 41 are pockets of circular bore shape axially extending throughout the drum and are open at both side surfaces of the drum.

The size of the holding pocket 42 may be set as appropriate depending on the size and shape of the sintered magnet body 1 to be accommodated therein. Although the size is not particularly limited, the diameter of the holding pocket 42 is preferably equal to the maximum diameter in cross section of the sintered magnet body 1 (maximum diagonal in case of rectangular shape) plus about 1 to 2 mm. This setting ensures that the sintered magnet body 1 is smoothly inserted and removed and the sintered magnet body 1 accommodated in the holding pocket 42 is conveyed in a steady manner without substantial movement within the pocket 42. The depth of the holding pocket 42 may be set as appropriate depending on the size of the sintered magnet body 1 and is generally at least 50%, preferably about 70 to 90% of the length of the sintered magnet body 1. Furthermore, the spacing between holding pockets 42 is preferably at least 10%, more preferably at least 30% of the diameter of the pocket. Since too large a spacing can detract from productivity, the spacing is preferably up to 100% of the pocket diameter.

As the conveyor drum 4 rotates, each holding pocket 42 enters the slurry 2 whereupon the slurry 2 flows into the holding pocket 42 from the openings at both ends, whereby the sintered magnet body 1 accommodated in the holding pocket 42 is immersed in the slurry. At least the main body of the conveyor drum 4 provided with the holding pockets 42 is preferably composed of a frame (not shown) and a mesh metal or punching metal in order that the slurry 2 flow into the pocket 42 and the sintered magnet body 1 accommodated in the pocket 42 be immersed in the slurry.

When the main body of the conveyor drum 4 is formed using a mesh metal or punching metal, the sintered magnet body 1 is effectively immersed in the slurry 2, and the amount of the slurry carried over by rotation of the conveyor drum 4 is reduced. This enables stable slurry coating. The efficiency of drying is increased during the drying step to be described later. The opening of the mesh metal or punching metal is preferably at least 1 mm so that the slurry 2 and drying air effectively flow therethrough. The upper limit is arbitrary as long as the sintered magnet body 1 is held in a stable manner.

As the conveyor drum 4 having the sintered magnet bodies 1 accommodated in the holding pockets 42 rotates clockwise as viewed in the figure, the sintered magnet bodies 1 are conveyed. Although the rotational speed of the conveyor drum 4 is not particularly limited, the rotational speed is set depending on the diameter of the drum, preferably so as to give a circumferential speed of 200 to 2,000 mm/min, more preferably 400 to 1,200 mm/min at the position where the holding pockets 42 are formed. If the circumferential speed, i.e., conveying speed is less than 200 mm/min, it is difficult to attain an industrially acceptable throughput. If the circumferential speed exceeds 2,000 mm/min, there may be inconvenience that short drying often occurs during treatment in a drying zone 3 to be described later, the size of a blower or the number of blowers must be increased in order to ensure drying, and the drying zone 3 must be scaled up. It is noted that although the rotation of the conveyor drum 4 may be continuous or intermittent, intermittent rotation is preferable when the efficiency of replacement operation of sintered magnet bodies 1 to be described later is taken into account.

As shown in FIG. 1, a range of the conveyor drum corresponding to 9 to 2 o'clock on the clock dial (range shown by arrow 3 in FIG. 1) is a drying zone 3. A drying means for blowing air to the holding pockets 42 is provided in this range. The air blow by the drying means may be hot air blow or normal temperature air blow. The temperature of air blow may be adjusted as appropriate depending on the drying time (conveying speed and length of drying zone), the size and shape of sintered magnet bodies, the concentration and coating weight of the slurry, and the like. Although the air blow temperature is not particularly limited, it is preferably in a range of the boiling point ($T_B$) of the slurry solvent ±50° C. When water is used as the solvent, for example, the temperature of hot air blow may be adjusted in a range of 40° C. to 150° C., preferably 60° C. to 100° C.

Now, in a first half portion of the drying zone 3, for example, in a range of the conveyor drum 4 corresponding to 9 to 10:30 o'clock on the clock dial, a residual droplet removing means (not shown) of injecting air may be set as a residual droplet removal section. Then the residual droplet removal section acts to inject air to the sintered magnet body 1 to remove any residual slurry on the surface of the sintered magnet body 1 before drying is carried out by blowing hot air as mentioned above. The residual droplet removal section (residual droplet removing means) is not necessarily essential. With the residual droplet removal section omitted, removal of residual droplets may be carries out at the same time as drying by the drying means. If drying is carried out with residual droplets remaining on the surface of sintered magnet body, there is a likelihood of uneven coating of the powder. It is preferred in this sense that residual droplets are fully removed by the residual droplet removal section (residual droplet removing means) before drying is carried out. In some cases, in order to accelerate drying, the air blow injected by the residual droplet removing means may also be hot air blow like that of the drying means.

The drying means and residual droplet removing means may be constructed by arranging a plurality of air injection nozzles (not shown) outside the conveyor drum 4 and along the circumference of the drum. Air or hot air is injected from the air injection nozzles to carry out the drying or residual droplet removal. Herein, the shape, size and angle (injection angle) of each nozzle may be set as appropriate depending on the size and shape of sintered magnet bodies 1, the material (mesh metal or punching metal) of the conveyor drum 4, and the like, and adjusted such that air or hot air may smoothly flow through the holding pockets 42 to effectively carry out drying and residual droplet removal.

It is noted that the flow volume of air or hot air injected from the nozzles in the drying means and residual droplet removing means may be adjusted as appropriate depending on the conveying speed of sintered magnet bodies 1, the length of drying zone 3 (the length of residual droplet removal section), the size and shape of sintered magnet bodies 1, the concentration and coating weight of the slurry 2 and the like. Although the flow volume is not particularly limited, it is typically adjusted in a range of 300 to 2,500 L/min, more preferably 500 to 1,800 L/min.

Though not shown, it is preferred that the drying zone 3 including the residual droplet removal section be provided with dust collecting means for recovering the rare earth compound powder removed from the surface of sintered magnet bodies 1 during the residual droplet removal and drying, by enclosing the dry zone 3 in a suitable chamber and installing a dust collector in the chamber for collecting dust. This enables coating of rare earth compound powder without wasting the rare earth compound containing noble rare earth element. In addition, the provision of the dust collecting means shortens the drying time, prevents hot air blow from diverting to the slurry coating section consisting of the coating tank and slurry agitating means as much as possible, and effectively prevents the slurry solvent from evaporating by the hot air blow. While the dust collector (not shown) may be of wet or dry type, it is preferred to select a dust collector having a greater suction capability than the flow volume of air injected from the nozzles in the residual droplet removing means and drying means.

As shown in FIG. 1, a range of the conveyor drum 4 corresponding to 2 to 3 o'clock on the clock dial (range shown by arrow 5 in FIG. 1) is a load/unload zone. In the load/unload zone 5, an uncoated sintered magnet body 1 is inserted into one holding pocket 42 and accommodated therein, and a coated sintered magnet body 1 having passed the immersion and drying steps is displaced from the holding pocket 42 and recovered. That is, in the load/unload zone 5, the coated sintered magnet body is displaced or replaced by an uncoated sintered magnet body.

With respect to the replacement of sintered magnet bodies 1, in one procedure, the coated sintered magnet body is taken out of the holding pocket 42 and thereafter the uncoated sintered magnet body is inserted into the holding pocket 42. In another procedure, the uncoated sintered magnet body is inserted into the holding pocket 42 from one side surface of the conveyor drum 4, and the coated sintered magnet body accommodated in the holding pocket 42 is displaced by this uncoated sintered magnet body to the other side surface of the conveyor drum 4 and recovered, whereby supply and recovery of sintered magnet bodies 1 are performed at the same time.

The supply and recovery of sintered magnet bodies 1 may be performed manually or automatically by providing a suitable supply mechanism and recovery mechanism. In either case, a support member (not shown) such as a rail is preferably provided so that the sintered magnet body 1 in a stable attitude may be guided to the holding pocket 42 or the sintered magnet body 1 in a stable attitude be moved out of the holding pocket 42.

Though not shown in FIGS. 1 and 2, the slurry 2 is contained in a box-shaped coating tank which is open at the upper end, and a portion of the conveyor drum 4 is immersed in the slurry 2 as mentioned above. The coating tank is equipped with agitating means (not shown) including a pump and a conduit. The agitating means serves to prevent precipitation of the rare earth compound in the slurry 2 and to keep the powder uniformly dispersed in the solvent. Also, the temperature of the slurry 2 may be adjusted as appropriate in a range of 10 to 40° C., and temperature management means such as a thermometer and heater may be provided if necessary.

When the sintered magnet body 1 is coated on its surface with a powder (rare earth compound powder) containing one or more compounds selected from an oxide, fluoride, oxyfluoride, hydroxide and hydride of $R_2$ (wherein $R_2$ is one or more elements selected from Y, Sc and rare earth elements) using the application device defined above, first the slurry 2 having the powder dispersed in a solvent is contained in the coating tank (not shown), and the slurry 2 is appropriately stirred by the agitating means (not shown) to maintain the powder in the slurry 2 to be uniformly dispersed in the solvent. In this state, as shown in FIG. 1, the sintered magnet bodies 1 to be treated are conveyed while they are accommodated in the holding pockets 42 in the conveyor drum 4 that rotates with a portion thereof being immersed in the slurry 2.

As described above, the sintered magnet body 1 which is accommodated in the holding pocket 42 in the load/unload zone 5 is conveyed forward by rotation of the conveyor drum 4 while it is held in the pocket 42, introduced into the slurry 2, where the magnet body is immersed in the slurry 2, passed through the slurry 2 over a predetermined time, and withdrawn from the slurry 2. In this course, the sintered magnet bodies 1 are successively coated with the slurry 2.

As the conveyor drum 4 rotates, the sintered magnet body 1 having the slurry 2 applied thereto is conveyed further and introduced into the drying zone 3 where drying operation is performed to remove the solvent of the slurry 2, the rare earth compound powder is tightly deposited on the surface of the sintered magnet body 10, to form a coating of rare earth compound powder on the surface of the sintered magnet body 10. At this point, if the drying zone 3 is provided with the residual droplet removal section, residual droplets are removed from the sintered magnet body 1 as withdrawn from the slurry 2, before drying treatment is performed on the sintered magnet body.

The sintered magnet body 1 which has been coated with the rare earth compound powder as mentioned above is conveyed further to the load/unload zone 5 again. In the load/unload zone 5, the sintered magnet body 1 coated with the rare earth compound powder is taken out of the holding pocket 42 and recovered, and the holding pocket 42 is charged with a new sintered magnet body 1 in the load/unload zone 5. Upon recovery and supply of sintered magnet bodies 1, a newly supplied uncoated magnet body is inserted into the holding pocket 42 from one side surface of the conveyor drum 4, and the coated magnet body which has been accommodated in the holding pocket 42 is displaced by this uncoated magnet body and recovered, thereby simultaneously performing recovery and supply of sintered magnet bodies 1. By repeating the series of operations continuously, a multiplicity of sintered magnet bodies are successively coated with the rare earth compound.

At this point, the step of coating the rare earth compound using the application device is repeated plural times on one sintered magnet body to coat the magnet body with the rare earth compound powder in an overlay manner, whereby a thicker coating is obtainable and the uniformity of a coating is improved. For repetition of the coating operation, the magnet body may be fed through one device plural passes to repeat the coating operation. The repeat operation may include feeding the sintered magnet body 1 to the conveyor drum 4, rotating the drum plural turns rather than one turn, and thereafter recovering the magnet body. In the case of double coating, for example, the sintered magnet body 1 is fed to the conveyor drum 4, the drum is rotated two turns to repeat the operation from slurry immersion to drying two times, and thereafter, the magnet body is recovered.

When the conveyor drum 4 having an even number of holding pockets 42 as shown in FIGS. 1 and 2 is used, in the case of double coating, for example, supply/recovery of sintered magnet body 1 may be performed every other turn (every two rotations). When the conveyor drum 4 having an odd number of holding pockets 42 is used, supply/recovery of sintered magnet body 1 may be performed every other pocket (in alternate pockets).

In another embodiment, a plurality of conveyor drums 4 are juxtaposed with their side surfaces closely opposed. The powder coating process is carried out on each conveyor drum, the sintered magnet body is inserted into the holding pocket in one drum, and at the same time, the sintered magnet body which has been accommodated in the pocket is displaced into the pocket in another drum and accommodated therein, whereby the coating process from slurry immersion to drying is repeated plural times.

Figure 3:
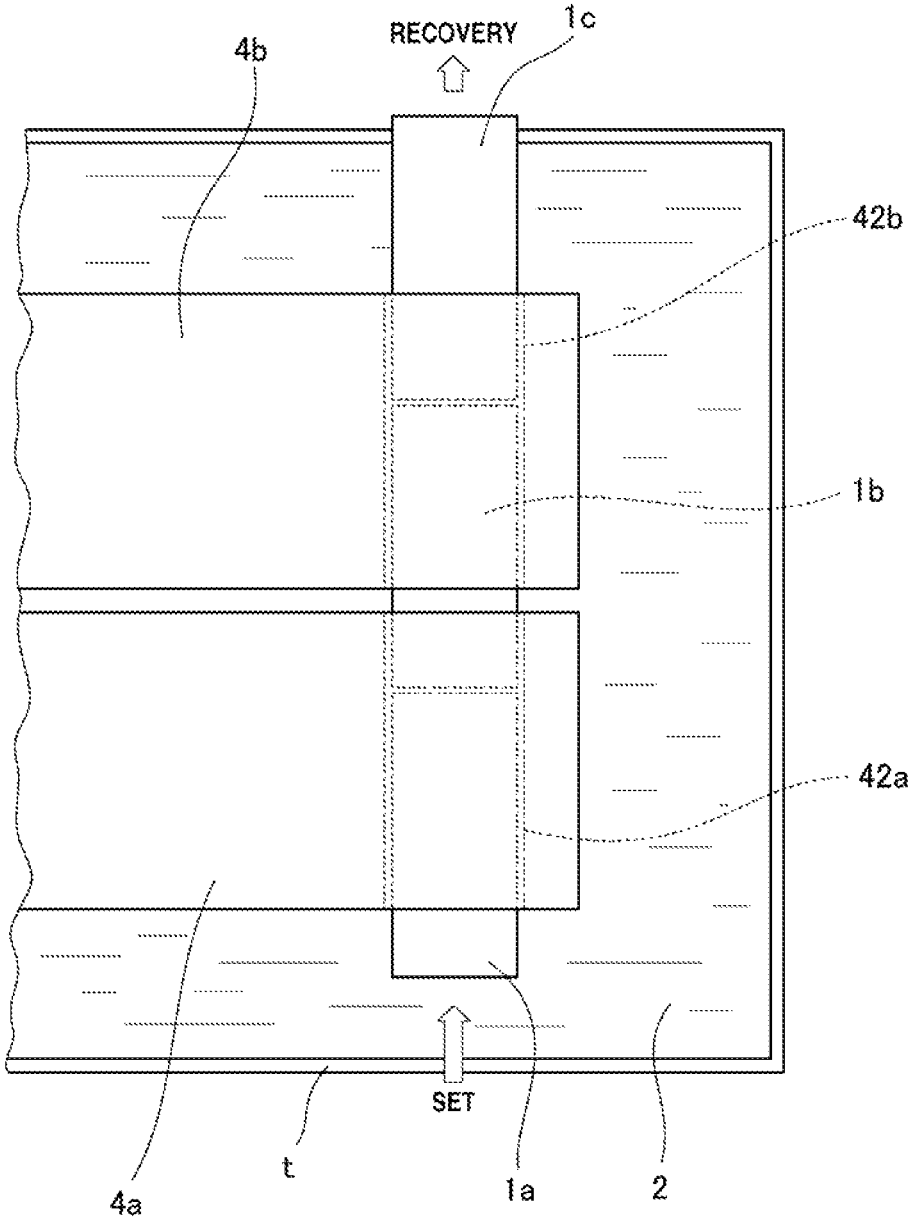
FIG. 3 is a schematic view showing a portion of the application device in another embodiment of the invention.

In the case of double coating, for example, as shown in FIG. 3, two conveyor drums 4*a* and 4*b* similar to the conveyor drum 4 are juxtaposed and rotated synchronously with the holding pockets 42 in the two drums 4*a* and 4*b* being aligned with each other. On each of the conveyor drums 4*a* and 4*b*, the coating process from slurry immersion to drying is carried out. The sintered magnet body which has undergone the first coating treatment on the first conveyor drum 4*a* is transferred to the second conveyor drum 4*b* where it undergoes the second coating treatment. Specifically, an uncoated sintered magnet body 1*a* is inserted and supplied into one holding pocket 42*a* in the first conveyor drum 4*a*. By this uncoated magnet body 1*a*, the once coated magnet body 1*a* which has been accommodated in the holding pocket 42*a* is displaced, transferred and inserted into the holding pocket 42*b* in the second conveyor drum 4*b*. By the once coated sintered magnet body 1*a*, the twice coated sintered magnet body 1*c* which has been accommodated in the holding pocket 42*b* is displaced and recovered. In FIG. 3, the slurry 2 is contained in a coating tank t.

In a further embodiment, the juxtaposition of plural conveyor drums as shown in FIG. 3 may be combined with the overlay coating by rotating the conveyor drum plural turns. For example, in the device shown in FIG. 3, overlay coating of four layers is possible by performing supply and recovery of sintered magnet bodies on every two turns. It is noted that the method of FIG. 3 using a plurality of conveyor drums has a throughput which is twice that of the method of rotating a single conveyor drum with the sintered magnet body plural turns, provided that the conditions are the same, and is advantageous in process efficiency. On the other hand, the method of rotating the conveyor drum plural times is advantageous in that the device is made simple and compact. By combining both methods, naturally overlay coating of 4 or more layers is possible. Efficient overlay coating with the advantages of both methods is possible.

In this way, the powder coating process from slurry application to drying is repeated plural times to achieve overlay coating of thin layers until a coating of desired thickness is reached. The overlay coating of thin layers is effective for reducing the drying time whereby the time-basis efficiency is improved.

In the inventive method for coating a sintered magnet body with a rare earth compound powder using the application device as mentioned above, as the sintered magnet body 1 is conveyed by the conveyor drum 4 while it is accommodated in the holding pocket 42 in the drum 4, it is subjected to slurry coating and drying. Even when coating step is continuously performed on a plurality of sintered magnet bodies 1, it is avoided that sintered magnet bodies come in contact with each other so that coating defects form at the contact areas. The slurry 2 can be uniformly and properly applied, and the powder be uniformly and efficiently coated. Since the conveyor drum 1 rotates while a portion thereof is immersed in the slurry 2 in the coating tank, the slurry 2 carried over by the conveyor drum 1 is returned to the coating tank due to rotation of the drum 1, and little of the slurry is carried out of the coating tank. The wasting of rare earth compound is suppressed quite effectively, as compared with the net conveyor system. Further, since the conveyance track of the sintered magnet body 1 by the conveyor drum 4 is a circular track about the horizontal axis extending above the coating tank, the device is made compact and the footprint of the device is substantially reduced, as compared with the net conveyor system entailing a horizontal conveyance track.

Accordingly, the sintered magnet body is coated on its surface with the rare earth compound powder uniformly and efficiently. The sintered magnet body uniformly coated with the powder is heat treated to cause absorptive diffusion of the rare earth element $R_2$ whereby a rare earth magnet having a fully increased coercivity and improved magnetic properties is efficiently produced.

Notably, the heat treatment to cause absorptive diffusion of the rare earth element $R_2$ may be performed by a well-known method. After the heat treatment, any well-known post-treatments including aging treatment under suitable conditions and machining to a practical shape may be performed, if necessary.

EXAMPLE

Embodiments of the invention are described by referring to Example although the invention is not limited thereto.

Example

A thin plate of alloy was prepared by a so-called strip casting technique, specifically by weighing amounts of Nd, Al, Fe and Cu metals having a purity of at least 99 wt %, Si having a purity of 99.99 wt %, and ferroboron, high-frequency heating in argon atmosphere for melting, and casting the alloy melt on a copper single roll in argon atmosphere. The resulting alloy consisted of 14.5 at % Nd, 0.2 at % Cu, 6.2 at % B, 1.0 at % Al, 1.0 at % Si, and the balance of Fe. The alloy was exposed to 0.11 MPa of hydrogen at room temperature for hydriding, and then heated at 500° C. for partial dehydriding while evacuating to vacuum. It is cooled and sieved, obtaining a coarse powder having a size of up to 50 mesh.

On a jet mill using high-pressure nitrogen gas, the coarse powder was finely pulverized to a weight cumulative median particle size of 5 μm. The resulting fine powder was compacted in a nitrogen atmosphere under a pressure of about 1 ton/$cm_2$ while being oriented in a magnetic field of 15 kOe. The compact was then placed in a sintering furnace in argon atmosphere where it was sintered at 1,060° C. for 2 hours, obtaining a magnet block. Using a diamond cutter, the magnet block was machined on all the surfaces, cleaned with alkaline solution, pure water, nitric acid and pure water in sequence, and dried, obtaining a block-shaped magnet body of 50 mm×20 mm×5 mm (in magnetic anisotropy direction).

Next, dysprosium fluoride powder was mixed with water at a mass fraction of 40% and thoroughly dispersed therein to form a slurry. Using the application device shown in FIGS. 1 and 2, the slurry was applied to the magnet body and dried, forming a coating of dysprosium fluoride powder. The coating conditions are shown below.

Coating Conditions

Coating tank volume: 10 L

Circulating flow rate of slurry: 60 L/min

Conveying speed: 700 mm/min

Flow volume of air for droplet removal and drying: 1,000 L/min

Temperature of hot air for drying: 80° C.

Coating number: single coating

Number of block-shaped magnet bodies: 100

The slurry spilling from the coating tank during treatment of 100 magnet bodies was collected, dried and weighed, which value is reported as the carry-over of slurry from the coating tank. Also the number of block-shaped magnet bodies which were brought in surface contact after coating was counted. The results are shown in Table 1.

The magnet bodies having a thin coating of dysprosium fluoride powder formed on their surface were heat treated at 900° C. for 5 hours in Ar atmosphere for absorptive treatment, age treated at 500° C. for 1 hour, and quenched, obtaining rare earth magnet samples. All magnet samples had satisfactory magnetic properties.

Comparative Example

Figure 4:
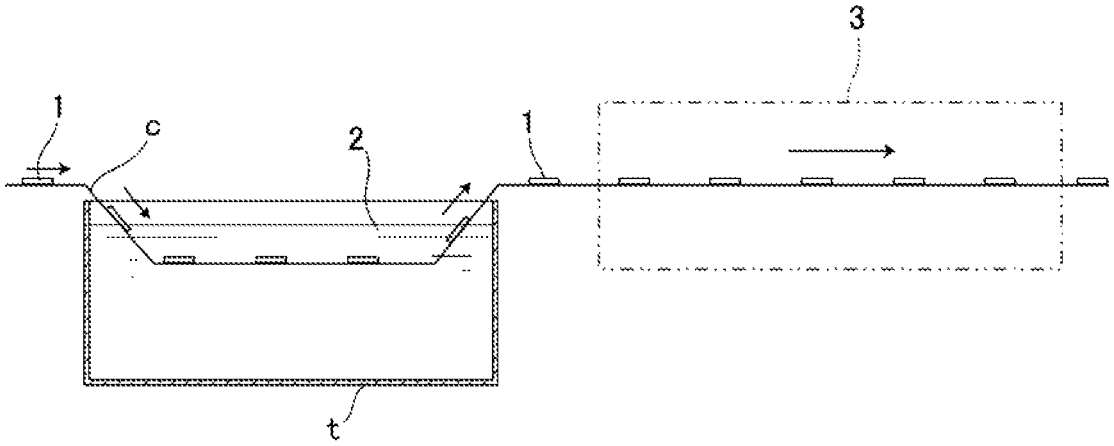
FIG. 4 is a schematic view showing a prior art rare earth compound applying system.

As in Example, there was furnished a block-shaped magnet body of 50 mm×20 mm×5 mm (in magnetic anisotropy direction). Also, dysprosium fluoride powder having an average particle size of 0.2 μm was mixed with water at a mass fraction of 40% and thoroughly dispersed therein to form a slurry, which was contained in a coating tank t of the prior art coating system shown in FIG. 4. The magnet body was coated with dysprosium fluoride by using the prior art coating system, and adjusting the conveying speed of net conveyor c, the residual droplet removing and drying conditions in drying zone 3, and the like so as to establish coating conditions equivalent to those of Example 1. The specifications of a net belt used in net conveyor c are as follows.

<Net Belt Specifications>

Type: conveyor belt
Form: triangular spiral
Spiral pitch: 8.0 mm
Rod pitch: 10.2 mm
Rod gauge: 1.5 mm
Spiral gauge: 1.2 mm As in Example, the carry-over of the slurry from the coating tank was measured. Also the number of block-shaped magnet bodies which exited the drying zone 3 in mutual surface contact state after coating was counted. The results are shown in Table 1. It is noted that the slurry carry-over is reported as an index provided that the carry-over of Example 1 is 1.

As in Example, the magnet bodies having a thin coating of dysprosium fluoride powder formed on their surface were heat treated at 900° C. for 5 hours in Ar atmosphere for absorptive treatment, age treated at 500° C. for 1 hour, and quenched, obtaining rare earth magnet samples.

TABLE 1

| | Slurry carry-over from coating tank (index based on 1 for Example) | Number of magnet bodies exiting in surface contact |
|---|---|---|
| Example | 1 | 0 |
| Comparative Example | 9.19 | 1 |

As is evident from Table 1, a comparison of slurry carry-over from the coating tank reveals that the carry-over of the application device comprising a rotating drum is about 89% smaller than that of the net conveyor system of serial movement. As is also evident from Table 1, the number of block-shaped magnet bodies which exited in mutual surface contact after coating is nil in the rotary drum pocket system of the invention (Example), demonstrating effective coating of powder.

REFERENCE SIGNS LIST

1 sintered magnet body
1*a* uncoated sintered magnet body
1*b* once coated sintered magnet body
1*c* twice coated sintered magnet body
2 slurry
3 drying zone
4 conveyor drum
4*a* first conveyor drum
4*b* second conveyor drum
41 horizontal axis
42 holding pocket
42*a* holding pocket in first conveyor drum
42*b* holding pocket in second conveyor drum
5 load/unload zone
c net conveyor
t coating tank

The invention claimed is:

1. A method for producing rare earth permanent magnet comprising the steps of:

providing a slurry comprising a solvent and a powder in the solvent in a slurry tank, and sintered magnet bodies of $R^1$—Fe—B composition, wherein $R^1$ is one or more elements selected from Y, Sc and rare earth elements, the powder containing one or more compounds selected from an oxide, fluoride, oxyfluoride, hydroxide and hydride of $R^2$, wherein $R^2$ is one or more elements selected from Y, Sc and rare earth elements;

arranging a conveyor drum having a plurality of holding pockets each for holding the sintered magnet body therein, wherein the holding pockets are circumferentially arranged in its periphery, and each of the holding pockets is a pocket of circular bore shape axially extending from a side surface to another side surface throughout the conveyor drum, over the slurry in the slurry tank so that the conveyor drum is rotatable around a rotation axis and at least one of said holding pockets is submerged in the slurry to apply the slurry to the sintered magnet body held in the holding pocket, inserting the sintered magnet body into each of said holding pockets at a predetermined position of the drum prior to entry into the slurry, so that the sintered magnet body is held in the holding pocket, rotating the conveyor drum so that the sintered magnet body is conveyed along a rotational track of the conveyor drum, immersed in the slurry, then withdrawn from the slurry, and further conveyed away from the slurry tank whereby the slurry is dried and the sintered magnet body is coated with the powder, recovering the sintered magnet body, which is coated with the powder, from the holding pocket at a predetermined position after the drying treatment and prior to re-entry into the slurry, and subjecting the sintered magnet body, which is recovered from the holding pocket, to a heat treatment for causing $R^2$ to be absorbed in the sintered magnet bodies, wherein each of the sintered magnet bodies coated with the powder is recovered from the holding pocket by inserting another sintered magnet body into the holding pocket from one of said side surfaces of the conveyor drum so that said another sintered magnet body pushes out the sintered magnet body coated with the powder, which is located in the same holding pocket as the holding pocket into which said another sintered magnet body is inserted, from an opposite side surface of the conveyor drum, whereby supply of said another sintered magnet body and recovery of the sintered magnet body coated with the powder are simultaneously performed at the same holding pocket.

2. The rare earth magnet producing method of claim 1 wherein a plurality of conveyor drums are juxtaposed with their side surfaces closely opposed, the powder coating process is carried out on each conveyor drum, the sintered magnet body is inserted into the holding pocket in one drum, and at the same time, the sintered magnet body, which has been accommodated in the pocket, is displaced into the pocket in another drum and accommodated therein, whereby the coating process from slurry immersion to drying is repeated plural times.

3. The rare earth magnet producing method of claims 1 or 2 wherein the sintered magnet body supplied into the holding pocket is recovered after the conveyor drum is rotated plural turns, whereby the coating process from slurry immersion to drying is repeated plural times.

4. The rare earth magnet producing method of claim 1 wherein the conveyor drum has a main body composed of a frame and a mesh metal or punching metal.

5. The rare earth magnet producing method of claim 1 wherein the step of drying the sintered magnet body which is withdrawn from the slurry and conveyed further includes blowing air thereto.

6. The rare earth magnet producing method of claim 5 wherein the drying step includes injecting air at a temperature within the boiling point ($T_B$) of the solvent in the slurry ±50° C. to the sintered magnet body.

7. The rare earth magnet producing method of claim 5 or 6 wherein the drying step includes injecting air to the sintered magnet body which is withdrawn from the slurry, for thereby removing any residual droplets, and then injecting hot air thereto.

* * * * *